US005397457A

United States Patent [19]

Harandi et al.

[11] Patent Number: 5,397,457

[45] Date of Patent: Mar. 14, 1995

[54] HYDROCARBON CONVERSION PROCESS

[75] Inventors: Mohsen N. Harandi, Langhorne, Pa.; Roger A. Morrison, Lambertville, N.J.

[73] Assignee: Mobil Oil Corporation, Fairfax, Va.

[21] Appl. No.: 203,185

[22] Filed: Feb. 25, 1994

[51] Int. Cl.[6] ..... C10G 47/18

[52] U.S. Cl. ..... 208/111; 585/708; 585/752

[58] Field of Search ..... 208/111; 585/708, 752

[56] References Cited

U.S. PATENT DOCUMENTS

| | | | |
|---|---|---|---|
| 3,668,269 | 6/1972 | Chloupek | 585/708 |
| 3,767,568 | 10/1973 | Chen | 208/134 |
| 3,923,641 | 12/1975 | Morrison | 208/111 |
| 4,647,368 | 3/1987 | McGuiness et al. | 208/60 |
| 4,812,223 | 3/1989 | Hickey, Jr. et al. | 208/111 |

*Primary Examiner*—Helem M. S. Sneed
*Assistant Examiner*—Bekir L. Yildirim
*Attorney, Agent, or Firm*—Alexander J. McKillop; Malcolm D. Keen; Jessica M. Sinnott

[57] ABSTRACT

A hydrocarbon fraction, preferably in the kerosene boiling range containing a substantial proportion of $C_9$+ hydrocarbons is contacted with an n-paraffin fraction, such as n-pentane, over a catalyst of acidic functionality, such as Pd/zeolite beta, under conditions of hydrocracking sufficient to convert the feed to lower boiling range materials of high octane number. The n-paraffin cofeed promotes isomerization and suppresses production of n-paraffins.

15 Claims, 1 Drawing Sheet

FIGURE
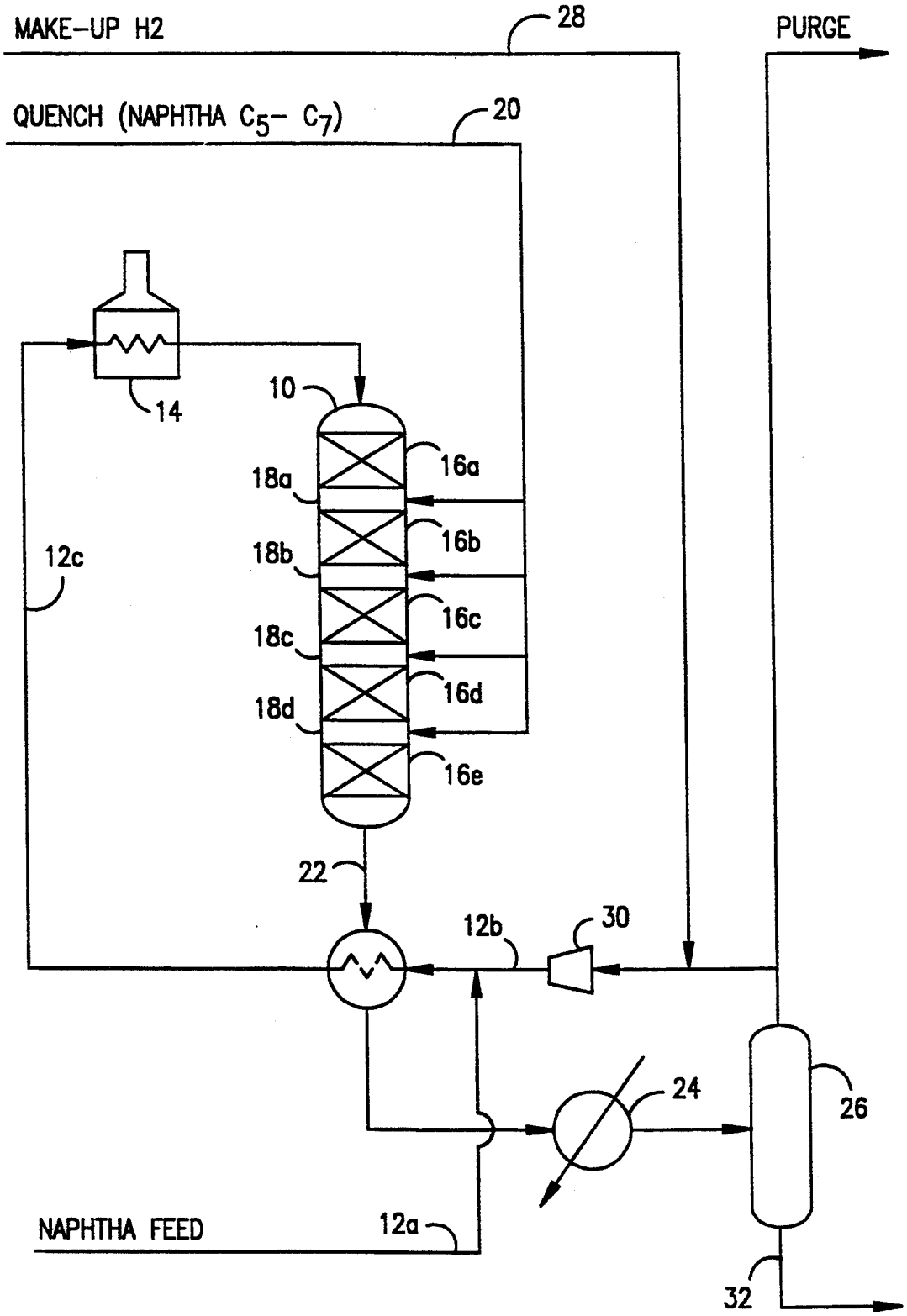

HYDROCARBON CONVERSION PROCESS

FIELD OF THE INVENTION

The invention relates to a process for converting a hydrocarbon fraction to a gasoline boiling range product.

BACKGROUND OF THE INVENTION

The conversion of naphthas, which, typically, begin to boil within the gasoline boiling range, about 285° F. (140° C.), and finish boiling in the distillate range, e.g. 400° F. (204° C.), to materials which begin and end boiling within the gasoline boiling range, $C_5$ to 330° F., is important to refiners.

Aromatic heavy naphtha fractions such as fluid catalytically cracked (FCC) 300°–425° F. products are high in octane, but because they begin to boil above the gasoline end boiling range, and may contain a large proportion of sulfur impurities, they require further processing to become commercially valuable as gasoline. However, it is difficult to eliminate, or at least reduce, the properties which make them undesirable as gasoline, i.e. the high sulfur content and high boiling point, without compromising the high octane properties that make them desirable as gasoline.

Recently, it has been reported that lowering gasoline endpoint to achieve a product endpoint where, in a standard ASTM distillation, 90 volume percent of the gasoline distills below 300° F. ($T_{90}$) will reduce pollution. Meeting this $T_{90}$ permits only 10% of the hydrocarbons in gasoline to boil above 300° F. A significant boiling range conversion of heavy naphthas will be required to meet this goal.

U.S. Pat. No. 3,923,641 to Morrison discloses hydrocracking a $C_7$+ naphtha over zeolite beta at moderate temperatures and pressures to achieve a high yield of iso-$C_4$. However, the disclosure is silent on the yield and quality of higher hydrocarbons.

U.S. Pat. No. 4,812,223 discloses hydrocracking a $C_5$+ naphtha over mildly steamed noble metal containing zeolite beta.

It is known that hydrocracking naphthas results in production of normal paraffins within the gasoline boiling range, particularly n-$C_5$. It would be advantageous to suppress these reactions since n-paraffins have low octane numbers as compared to other gasoline boiling range components such as iso-paraffins.

SUMMARY OF THE INVENTION

We have found that a kerosene boiling range feed can be converted to gasoline boiling range hydrocarbons of improved octane by treating the feed over a zeolite catalyst in the presence of hydrogen and an n-paraffin feedstream, such as an n-pentane containing hydrocarbon stream.

We discovered a process in which reacting an n-paraffin containing feedstream in a hydrocracking zone along with a kerosene boiling range feed surprisingly resulted in suppression of n-paraffin production during the hydrocracking reactions. We also found that the process converts a portion of the n-paraffins introduced to the process to higher octane components and that isomerization of the n-paraffins occurs at higher severities.

An object of this process is to produce gasoline.

A feature of this invention is to react a catalytically cracked heavy hydrocarbon fraction with an n-paraffin over a catalyst of acidic functionality to produce gasoline boiling range hydrocarbons.

An advantage of the invention is that the n-paraffins undergo a reaction during hydrocracking of the catalytically cracked hydrocarbon fraction to produce higher octane gasoline boiling range hydrocarbons.

This invention is directed to a process for upgrading a hydrocarbon fraction which begins to boil above 285° F. (140° C.) containing a significant proportion of $C_9$+ hydrocarbons; comprising the steps of:

(a) feeding the hydrocarbon fraction and a lower n-paraffin feed fraction to a reaction zone; and (b) processing the feeds in the reaction zone over a catalyst of acidic functionality under conditions of elevated temperature and pressure to convert the feed to a product comprising a hydrocarbon fraction having a larger proportion of hydrocarbons boiling in the gasoline boiling range and a lower proportion of n-paraffins than the feed.

BRIEF DESCRIPTION OF THE DRAWING

The FIGURE is a simplified schematic flow diagram of the kerosene conversion process of this invention.

DETAILED DESCRIPTION

First Feed

The feed to the process comprises a naphtha fraction, specifically a heavy naphtha in the kerosene boiling range, characterized by a boiling range of about 285° F. (140° C.) to about 650° F. (100° C. to 329° C.), more specifically about 300° F. to 450° F. (149° C. to 232° C.).

A source of this feed stream includes straight run naphtha which is optionally pretreated to remove sulfur and other impurities. Hydrotreated and/or hydrocracked naphthas are also contemplated.

The refinery feed stream contains a substantial proportion of higher boiling range hydrocarbons, typically $C_9$, $C_{10}$ and higher hydrocarbons and hydrocarbons which range up to $C_{13}$ to $C_{20}$. A catalytically cracked, i.e. TCC or FCC, preferably an FCC, heavy naphtha feed typically comprising sulfur impurities is specifically contemplated. The fraction, typically, exceeds 100 ppmw sulfur and in most cases 500 ppmw sulfur. A hydrotreated FCC naphtha containing low sulfur is also a suitable feed. The FCC heavy naphtha feed contemplated usually contains some $C_9$+ hydrocarbons and small amounts of lower hydrocarbons (e.g., $C_8$and lower hydrocarbons). In some instances, at least 70% of the feed will be in the range of $C_9$ to $C_{13}$, with, typically, no more than about 20%, more specifically about 15% $C_{15}$+ hydrocarbons. The FCC heavy naphtha contains a large proportion of methyl-branched aromatics as well as a complex mixture of methyl, ethyl, propyl, and isopropyl groups in addition to naphthalenes and methylnaphtalenes.

SECOND FEED

A stream which contains n-paraffins is also used. A suitable stream is a paraffinic light straight run naphtha or other paraffinic refinery stream derived from any suitable source such as a depentanizer, dehexanizer or debutanizer. Also useful sources are a raffinate stream such as a Udex raffinate or an unconverted n-paraffin stream from an isomerization unit.

This stream will, typically, comprise a predominant amount of lower n-paraffins such as $C_4$ to $C_6$ hydrocarbons. Usually, the n-paraffin feed will not contain n-paraffins having greater than 8 carbon atoms nor less than 3 carbon atoms, although very minor amounts of these can be included. Typically, the n-paraffin feed will contain at least about 20 wt. % $C_4$ to $C_5$ n-paraffins, more specifically about 45 wt. % $C_4$ to $C_6$ n-paraffins. The presence of other materials such as cyclic hydrocarbons and branched hydrocarbons are not excluded from the feed.

COMBINED FEED

Any combination of the above feed streams are within the scope of this invention. However, the preferred combined feed should contain at least about 60 to 90 wt. % of the first feed and at least 10 to 40 wt. % of the second feed. The relative proportion will, however, depend on specific refinery needs and feedstock availability.

PROCESS CONDITIONS

The heavy naphtha stream is converted by contact, in the presence of a light n-paraffin stream, with a catalyst of acidic functionality under conditions which convert a fraction of the feed to components which boil in the gasoline boiling range and have a higher octane value than the feed to this step. The total wt. % conversion of $C_{10}+$ components will be at least about 20 wt. %, typically, ranging from about 70 wt % to about 100 wt. %

A convenient mode of operation is to pass the n-paraffin feed to this conversion step directly from the refinery source, such as the fractionator, to the reaction zone or as a feed additive to the heavy naphtha.

In another mode of operation, one of the feeds is an interreactor quench which controls the exotherm of the hydrocracker.

The conditions used are selected to encourage hydrocracking of the heavy naphtha to produce lighter branched hydrocarbons and isomerization of n-paraffins.

Generally, the conditions of temperature will range from about 400° F. to about 800° F., specifically from about 450° F. to about 650° F. Relatively moderate pressures have been found to be effective. Typically, pressures should be maintained from about 50 psig to about 2000 psig, specifically from about 100 to about 1500 psig, more specifically from about 200 to about 400 psig.

The space velocities, typically, range from about 0.1 to about 20 W.H.S.V., specifically from about 0.5 to about 5 W.H.S.V., more specifically from about 2 to about 4 W.H.S.V. Hydrogen to hydrocarbon ratios typically range from about 0.1:1 to about 20:1, specifically 1:1 to 10:1.

The catalytic material which is useful in this process is any catalyst of acidic functionality typically a solid, porous material. That is, the catalysts of this invention include crystalline aluminosilicate zeolites and amorphous materials.

The preferred catalysts for this purpose are the large pore and intermediate pore size zeolitic behaving catalytic materials.

These zeolitic catalytic materials are exemplified by those which, in their aluminosilicate form would have a Constraint Index between about 0.4 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service. A typical zeolite is Pd/zeolite beta.

Examples of suitable zeolites are those having the topology of zeolite Y, zeolite X, mordenite, zeolite beta, ZSM-5, ZSM-11, ZSM-12, ZSM-22, ZSM-23, ZSM-35, ZSM-48, ZSM-50, MCM-22, MCM-36, MCM-49, and MCM-56. Other catalytic materials having the appropriate acidic functionality may also be employed.

These materials are exemplary of the topology and pore structure of suitable acid-acting refractory solids; useful catalysts are not confined to the aluminosilicates and other refractory solid materials which have the desired acid activity, pore structure and topology may also be used. The zeolite designations referred to above, for example, define the topology only and do not restrict the compositions of the zeolitic-behaving catalytic components.

The amorphous acid catalysts are, typically, silica-alumina but other porous oxides are contemplated such as silica-zirconia, silica-thoria, silica-magnesia, zirconia, tungsten oxide, zirconia-tungsten oxide and the like.

In any event, the catalyst should have sufficient acid activity to have hydrocracking activity with respect to the $C_{10}+$ hydrocarbons for selected $C_{10}+$ conversion.

One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant$=0.016^{sec-1}$). The alpha test is described in U.S. Pat. No. 3,354,078 and in *J. Catalysis*, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis*, 61, 395 (1980).

The catalyst used in the process suitably has an alpha activity of at least about 10, usually in the range of 50 to 800 and preferably at least about 100 to 300. Maximum catalyst activity is usually required to promote the desired reactions.

The zeolite, will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania and alumina.

The catalyst used in this process may contain a metal hydrogenation function for improving catalyst aging or regenerability. Metals such as the Group VIII base metals or combinations can be used, for example nickel. Noble metals such as platinum or palladium may also be utilized. The catalyst may also contain aromatization metals such as Zn or Ga.

The particle size and the nature of the catalyst will usually be determined by the type of conversion process which is being carried out, such as: a down-flow, fixed bed process; an up-flow, fixed bed process; fixed fluidized bed; moving bed; transport, fluidized bed process with the fixed-bed type of operation preferred. The reaction operates in the gas phase or mixed gas-liquid phase.

The conditions of operation and the catalysts should be selected to result in a product slate in which the gasoline product octane is enhanced over the feed and to achieve at least the octane of the feed with a significant increase in the volumetric yield of the $C_{10}$— gasoline boiling range product and higher octane components such as isoparaffins.

The FIGURE represents one embodiment of the invention. Referring to the FIGURE, a vapor phase hydrocracked heavy naptha hydrocarbon feedstream in the kerosene boiling range is introduced to the process via line 12*a* and combined with hydrogen introduced via line 12*b*. The feed is conveyed to reactor 10 via conduit 12*c*. The feedstream is elevated to a temperature ranging from 400°–500° F. in process furnace 14 prior to its introduction to reactor 10. In reactor 10, there are (optionally) a plurality of catalytic zones 16*a*, 16*b*, 16*c*, 16*d*, and 16*e* associated with cooling zones 18*a*, 18*b*, 18*c* and 18*d*. The cooling zones help avoid overcracking by controlling the heat of reaction. This can be accomplished by any convenient means although a $C_5$–$C_7$ naptha quench introduced via conduit 20 is acceptable. Alternatively, an interstage heat exchange may be employed (not shown). The hydrocracked and isomerized product is withdrawn from reactor 10 via line 22. The product stream is cooled in cooler 24 and fractionated in drum 26 to remove the light ends including hydrogen which is combined with make-up hydrogen introduced via line 28 and condensed in condenser 30. The hydrogen is recycled to reactor 10 via line 12*b*. Higher boiling range materials including $C_7$+ naptha are withdrawn via line 32 for separation of high octane gasoline.

EXAMPLES

The following examples illustrate the advantages and operation of the process. In the examples, parts and percentages are by weight unless they are expressly stated to be on some other basis. Temperatures are in °F. and pressures in psig, unless expressly stated to be on some other basis. In all the examples conversions were conducted over a Pd/zeolite beta catalyst.

Example 1

Comparison Example (Kerosene Feed Only)

The process was operated with a hydrofinished feed, the properties of which are reported in Table 1.

TABLE 1

| Kerosene Composition, wt % | |
|---|---|
| $C_8$'s | 0.13 |
| $C_9$'s | 1.46 |
| $C_{10}$'s | 8.70 |
| $C_{11}$'s | 23.62 |
| $C_{12}$'s | 38.00 |
| $C_{13}$+'s | 28.09 |

The following Table 2 sets forth conditions of the kerosene conversion operation and the results.

TABLE 2

| Conversion of Kerosene Feed | |
|---|---|
| Temperature, °F. | 526 |
| Pressure, psig | 800 |
| WHSV | 2.02 |
| $H_2$:HC | 4:1 |
| Product Dist., Wt. % | |
| $C_4$- | 24.82 |
| i-$C_5$ | 10.43 |
| n-$C_5$ | 2.06 |
| $C_5$= | 0 |
| $C_6$ to $C_9$ | 57.42 |
| $C_{10}$+ | 5.28 |

As demonstrated by the data, conversion under the conditions of the test resulted in an overall reduction in the $C_{10}$+ components of the feed and was accompanied by production of lower paraffins (n$C_5$).

Example 2

Example of Kerosene and N-Paraffin Combined Feed

A kerosene feed similar to that described in Table 1 was combined with an n-pentane feed to achieve a feedstock having the properties set out in the following Table 3.

TABLE 3

| Kerosene/N-Pentane Feed | |
|---|---|
| n-$C_5$'s | 23.57 |
| i-$C_5$'s | 0.11 |
| $C_9$'s | 1.17 |
| $C_{10}$'s | 6.89 |
| $C_{11}$'s | 18.29 |
| $C_{12}$'s | 27.98 |
| $C_{13}$+'s | 21.86 |

The above feed was subjected to hydrocracking at a relatively low pressure (Run A) and a relatively high pressure (Run B). The following Table 4 sets forth the conditions of operation and the results.

TABLE 4

| Conversion Kerosene/N-Pentane Feed | | |
|---|---|---|
| Run | A | B |
| Temperature, °F. | 526 | 600 |
| Pressure, psig | 200 | 600 |
| WHSV | 2.01 | 2.0 |
| $H_2$:HC | 4:1 | 2:1 |
| Product Dist. Wt. % | | |
| $C_4$- | 16.8 | 29.54 |
| i-$C_5$ | 8.77 | 23.32 |
| n-$C_5$ | 22.51 | 16.94 |
| $C_5$= | 0 | 0 |
| $C_6$ to $C_9$ | 37.25 | 29.56 |
| $C_{10}$+ | 10.34 | 0.61 |

As demonstrated by the data of Table 4, conversion under the conditions of the test resulted in an overall reduction in the n-paraffins produced over the n-paraffins of the feed, compare product n-$C_5$=22.5 and 16.94 with feed n-$C_5$=23.5%. Additionally, under high severity conditions isomerization of paraffins occurred as demonstrated by comparing the ratio of i-$C_5$ to n-$C_5$ of the product of Run B. These conversions were also accompanied by a significant reduction in $C_{10}$+ hydrocarbons.

What is claimed is:

1. A process for upgrading a hydrocarbon fraction which begins to boil at about 285° F. (140° C.) and contains a significant proportion of $C_9$ hydrocarbons, comprising the steps of;

a) feeding the hydrocarbon fraction and a lower n-paraffin feed fraction to a hydrocracking reaction zone; and b) hydrocracking the feeds in the hydrocracking reaction zone of step a) over a catalyst of acidic functionality in the presence of hydrogen, under conditions of elevated temperature and pressure to convert the feed to a product comprising a hydrocarbon fraction having a larger proportion of hydrocarbons boiling in the gasoline boiling range and a lower proportion of n-paraffins than the feed.

2. The process as claimed in claim 1 in which the catalyst of acidic functionality comprises a zeolite.

3. The process as claimed in claim 1 in which the catalyst of acidic functionality comprises a zeolite selected from the group consisting of ZSM-5, zeolite beta, MCM-22, MCM-36, MCM-49, MCM-52, MCM-56, zeolite Y, zeolite X and mordenite.

4. The process as claimed in claim 3 in which the zeolite is in the aluminosilicate form.

5. The process as claimed in claim 1 in which the n-paraffin fraction comprises n-butane, n-pentane, n-hexane and/or n-heptane.

6. The process as claimed in claim 1 in which the hydrocarbon fraction has a boiling range within the range of about 300° F. to 450° F.

7. The process of claim 1 in which the n-paraffin comprises n-pentane.

8. The process as claimed in claim 1 in which the catalyst of acidic functionality comprises a noble metal.

9. The process of claim 1 in which the catalyst comprises Pd-zeolite beta.

10. The process of claim 1 in which the source of n-paraffin feed is a raffinate, hydrocracked naphtha, paraffin by-product of an isomerization unit, or product of a debutanizer or depentanizer.

11. The process of claim 1 in which the conditions of the reaction zone comprise temperatures ranging from about 400° to 800° F., weight hourly space velocity of about 0.1 to 20, pressure of about 50 to 2000 psig, and hydrogen to hydrocarbon ratios ranging from about 0.1:1 to 20:1.

12. The process of claim 1 in which the conditions of the reaction zone comprise temperatures ranging from about 450° to 650° F., weight hourly space velocity of about 0.5 to 5.0, pressure of about 100 to 1500 psig, and hydrogen to hydrocarbon ratio of about 1:1 to 10:1.

13. The process as described in claim 1 in which the hydrocarbon fraction is in the kerosene boiling range.

14. The process of claim 1 which further comprises conducting the step of hydrocracking of step b) by contacting the feed in a plurality of catalytic zones which contain the catalyst of acidic functionality.

15. The process of claim 1 which further comprises conducting the step of hydrocracking of step b) by contacting the feed in a plurality of distinct catalytic zones and further comprising the step of controlling the heat of reaction by cooling with a quench fluid.

* * * * *